US006454256B1

(12) United States Patent
Boguhn et al.

(10) Patent No.: US 6,454,256 B1
(45) Date of Patent: Sep. 24, 2002

(54) DEVICE FOR LATERALLY ALIGNING SHEETS

(75) Inventors: Hans Peter Boguhn, Heidelberg; Markus Möhringer, Mannheim, both of (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/523,111

(22) Filed: Mar. 10, 2000

(30) Foreign Application Priority Data

Mar. 10, 1999 (DE) ..... 199 10 688

(51) Int. Cl.[7] ..... B65H 9/00
(52) U.S. Cl. ..... 271/238; 271/240; 271/263
(58) Field of Search ..... 271/92, 94, 105, 271/226, 238, 228, 240, 261, 263, 265.04, 265.03, 262, 227

(56) References Cited

U.S. PATENT DOCUMENTS 3,593,989 A * 7/1971 Crittenden ..... 271/238
4,245,836 A * 1/1981 Jooster ..... 271/228
4,879,513 A 11/1989 Spiegel et al.
5,267,728 A * 12/1993 Simeth ..... 271/228

FOREIGN PATENT DOCUMENTS

| | | | |
|---|---|---|---|
| DE | 1 015 009 | 9/1957 | |
| DE | 22 00 187 | 8/1972 | |
| DE | 29 21 842 | 12/1980 | |
| DE | 3536533 A1 * | 5/1986 | |
| GB | 2175 573 A * | 12/1986 | ..... 271/238 |

* cited by examiner

*Primary Examiner*—H. Grant Skaggs
(74) *Attorney, Agent, or Firm*—Laurence A. Greenberg; Werner H. Stemer; Gregory L. Mayback

(57) ABSTRACT

A device for laterally aligning a sheet on a feeding table of a sheet-processing machine, wherein a sheet is moved transversely to the sheet-transporting direction by a pulling device, and a multiple-sheet monitoring device activatable during the pulling operation is assigned to the pulling device, includes another pulling device disposed opposite the first-mentioned pulling device, and a pressure-exerting roller with multiple-sheet monitoring assigned to each of the pulling devices, respectively, for sheet stabilization.

4 Claims, 2 Drawing Sheets

DEVICE FOR LATERALLY ALIGNING SHEETS

BACKGROUND OF THE INVENTION

Field of the Invention

The invention relates to a device for laterally aligning sheets on a feeding table of a sheet-processing machine with a device for detecting multiple sheets.

In sheet-processing machines, particularly sheet-fed rotary printing machines, a problem arises wherein the sheets which are to be aligned laterally become positioned obliquely during the lateral pulling movement.

In order to solve this problem, it has become known heretofore from the published German Patent Document DE 35 36 533 A1 to arrange a holding or retaining roller at an intersection point of the center of the feeding table and the direction in which a lateral pulling device acts, and to provide this holding or retaining roller with a device for detecting multiple sheets.

SUMMARY OF THE INVENTION

It is accordingly an object of the invention to provide an improved device for laterally aligning sheets, wherein devices for detecting multiple sheets are provided.

With the foregoing and other objects in view, there is provided, in accordance with the invention, a device for laterally aligning a sheet on a feeding table of a sheet-processing machine, wherein a sheet is moved transversely to the sheet-transporting direction by a pulling device, and a multiple-sheet detecting device activatable during the pulling operation is assigned to the pulling device, comprising another pulling device disposed opposite the first-mentioned pulling device, and a pressure-exerting roller with multiple-sheet monitoring assigned to each of the pulling devices, respectively, for sheet stabilization.

In accordance with another feature of the invention, both pressure-exerting rollers with multiple-sheet monitoring are activatable when one of the two pulling devices is activated.

In accordance with a further feature of the invention, upon activation of one of the pulling devices, the respective pressure-exerting roller with multiple-sheet monitoring disposed on the opposite side of the sheet from the respective one pulling device is activatable.

In accordance with a concomitant feature of the invention, the aligning device includes a respective, freely rotatably mounted counter-roller cooperating with each of the pressure-exerting rollers, respectively.

An advantage derived from the invention is that the device for detecting multiple sheets executes a holding or retaining function and, for this purpose, is arranged at an especially desirable retaining or holding location, namely at the side of the sheet, respectively, that is located opposite the pulling device.

Due to this measure, only very small holding or retaining forces have to be expended in the sheet-transporting direction in order to achieve parallel guidance for the sheet during the lateral alignment.

The arrangement of two lateral pulling devices allows the sheets to be aligned both at lefthand lateral stops and at righthand lateral stops. Arranging two multiple-sheet monitoring devices in the region of the lateral pulling device ensures the detection of bent-over or dog-eared sheet corners in addition. to double and multiple sheets.

In order to improve the sliding properties of the sheet during the lateral alignment, the multiple-sheet monitoring device or control has a pressure-exerting roller that cooperates with a freely rotatably mounted counter-roller.

Other features which are considered as characteristic for the invention are set forth in the appended claims.

Although the invention is illustrated and described herein as embodied in a device for laterally aligning sheets, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
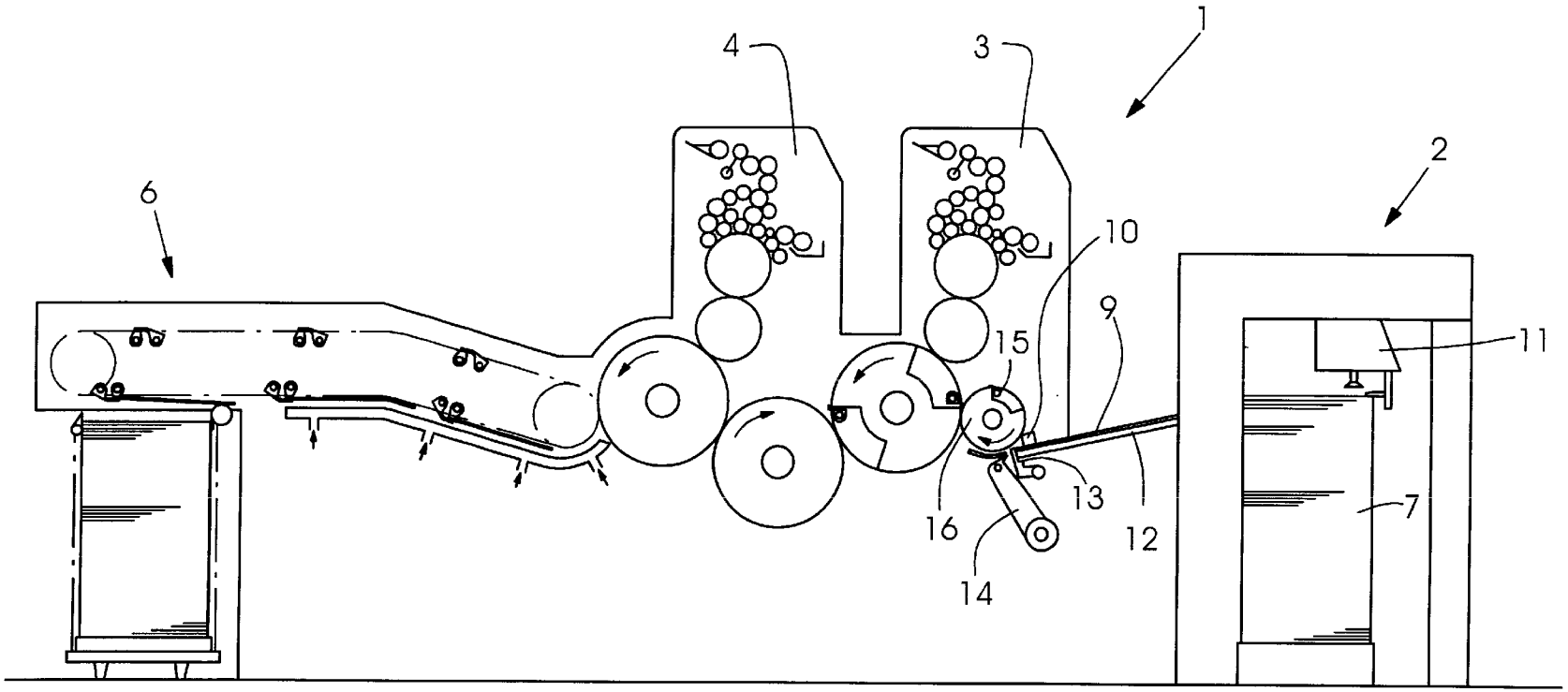
FIG. 1 is a diagrammatic side elevational view of a sheet-fed rotary printing machine incorporating the device for laterally aligning sheets in accordance with the invention.

Referring now to the drawings and, more particularly, to FIG. 1 thereof, there is shown therein a sheet-fed rotary printing machine 1 having a sheet feeder 2, for example two printing units 3 and 4, although it may also have just one or more than two printing units, and a delivery 6. Sheets 9 are singled out or singly separated from a sheet pile 7 of the feeder 2 by a conventional separating unit 11 and are conveyed to the sheet-fed rotary printing machine 1 via a feeding table 12. Provided at an end of the feeding table 12, which is directed towards the printing machine 1, is a lateral pulling or drawing device 10 for laterally aligning the sheets 9, as well as front stops 13 for aligning front or leading edges of the sheets 9. After the aligning operation has taken place, the sheets 9 are received by a pivotably or swivellably arranged pre-gripper 14, which transfers the sheets 9 to a gripper device 15 of a feed drum 16 of the sheet-fed rotary printing machine 1.

Figure 2:
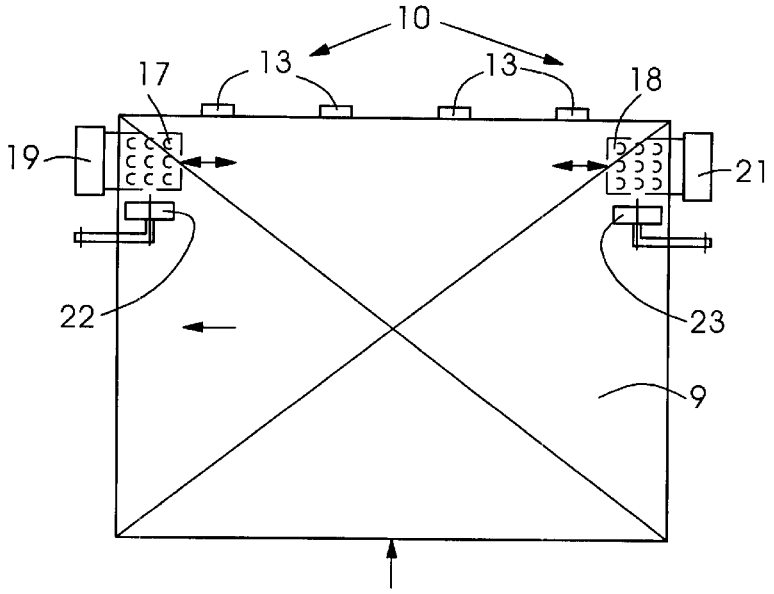
FIG. 2 is an enlarged fragmentary plan view of FIG. 1, rotated 90° clockwise and showing a sheet that is to be aligned.

As shown in FIG. 2, the lateral pulling device 10 has two pulling bars or rails 17 and 18 which are preferably subjected to the action of suction air in order to be able to exert a retaining or holding force on the sheet 9 which is to be aligned. The pulling bars 17 and 18, respectively, are disposed opposite one another, in a lateral border region of; the sheet 9 that is to be aligned, and beneath the plane in which the sheet 9 is being transported.

As seen in the sheet-transporting direction and as marked by an arrow in FIG. 2, respectively, a lateral stop 19, 21 is provided on the lefthand and righthand sides, the sheet 9 being selectively alignable thereon.

Immediately upline of the pulling bar or rail 17, 18, as viewed in the sheet-transporting direction, there is provided a pressure-exerting roller 22, 23, respectively, which is pivotable cyclically in time with the printing machine, and cooperates with a respective counter-roller 24, 26 (note FIG. 3) which is mounted freely rotatably in the feeding table 12, beneath the transporting plane.

Figure 3:
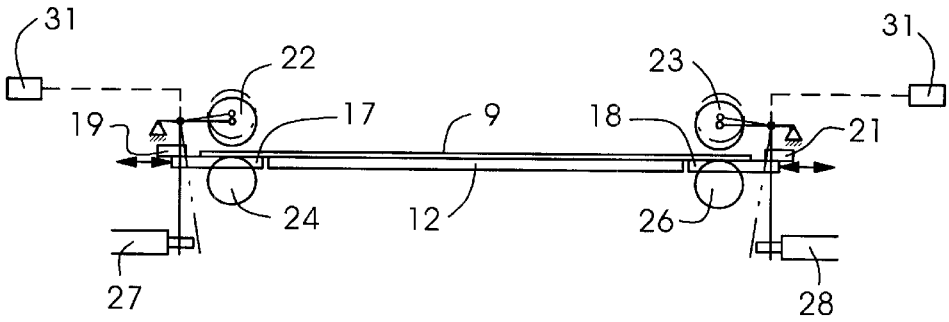
FIG. 3 is a rear elevational view of FIG. 2 showing the sheet that is to be aligned seated on a feeding table of the sheet-processing machine.

As further shown in FIG. 3, the pressure-exerting rollers 22 and 23 and the corresponding counter-rollers 24 and 26 are mounted so that they are rotatable transversely to the sheet-transporting direction, i.e., in the direction of the lateral alignment.

Figure 4:
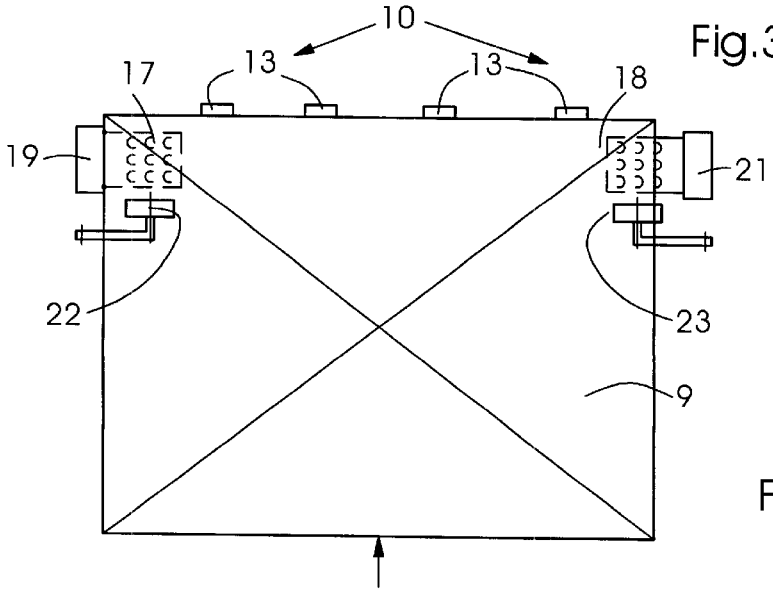
FIG. 4 is a view like that of FIG. 1 in an operating phase of the sheet-aligning device wherein a sheet is in a laterally aligned position.

As is apparent from FIG. 1, a sheet 9 transported in the direction of the sheet-fed printing machine 1 reaches the front stops 13 and is aligned thereat in the circumferential direction of the following cylinders, e.g., the feed drum 16. For the subsequent lateral alignment of the sheet 9 at the lateral stop 19, as shown in FIG. 4, the sheet 9 is pulled against the lateral stop 19 by the pulling bar or rail 17 that has been subjected to the action of suction air.

After the leading-edge alignment and circumferential alignment, respectively, of the sheet 9, and in order to detect multiple sheets and, at the same time, to guide the sheet 9 during the lateral alignment by the pulling rail 17, the pressure-exerting or control roller 23 is lowered by a.,cam 28 (note FIG. 3) onto the sheet 9 in the region of the rotatably mounted counter-roller 26.

The sheet 9 which, in this exemplary embodiment, is drawn against the lefthand lateral stop 19, is guided by the pressure-exerting roller 23, arranged on the other or right-hand side, and the counter-roller 26, for sheet stabilization, so that the sheet 9 is prevented from springing back or moving away from the front stops 13.

The pressure-exerting rollers 22 and 23 are, at the same time, provided with a device for multiple-sheet monitoring and are connected to a control computer 31 of the printing machine 1 by corresponding lines. When multiple sheets are detected, the printing machine is switched off, e.g., via the control computer 31.

For further improved guidance of the sheet 9 that is to be aligned laterally, it is also possible for the pressure-exerting rollers 22 and 23 to be activated simultaneously.

It is possible, by this procedure, to determine multiple sheets at the same time at two different measuring locations, due to which the reliability of the measuring operation increases. It is also possible simultaneously to detect dog-eared or folded-over sheet corners on the side located opposite the activated pulling bar or rail 17 and 18, respectively.

We claim:

1. A device for laterally aligning a sheet on a feeding table of a sheet-processing machine, comprising;

a first pulling device for moving the sheet transversely to a sheet transporting direction;

a second pulling device for moving the sheet transversely to a sheet transporting direction disposed opposite said first pulling device;

a pressure-exerting roller assigned to each of said pulling devices for stabilizing the sheet in a direction of lateral alignment of a sheet, said pressure-exerting roller being mounted rotatably and transversely to the sheet-transporting direction; and a multiple-sheet monitoring device activatable during a pulling operation assigned to each said pressure-exerting roller.

2. The lateral aligning device according to claim 1, wherein both pressure-exerting rollers with multiple-sheet monitoring activatable when one of the two pulling devices is activated.

3. The device according to claim 1, wherein, upon activation of one of the pulling devices, the respective pressure-exerting roller with multiple-sheet monitoring disposed on the opposite side of the sheet from the respective one pulling device is activatable.

4. The device according to claim 1, including a respective, freely rotatably mounted counter-roller cooperating with each of said pressure-exerting rollers, respectively.

* * * * *